United States Patent [19]

Means

[11] Patent Number: 4,780,088

[45] Date of Patent: Oct. 25, 1988

[54] CONNECTING PLUG FOR ELECTRICAL SWITCHES AND RECEPTACLES

[76] Inventor: Eugene E. Means, 500 W. 27th St., Sioux City, Iowa 51103

[21] Appl. No.: 86,425

[22] Filed: Aug. 17, 1987

[51] Int. Cl.[4] ..... H01R 19/44

[52] U.S. Cl. ..... 439/107; 439/535

[58] Field of Search ..... 174/53, 59; 439/106, 439/107, 651, 652, 535–538, 92, 95–97, 569, 682, 685, 693

[56] References Cited

U.S. PATENT DOCUMENTS

| | | | |
|---|---|---|---|
| 2,397,688 | 4/1946 | Osinski | 174/53 |
| 2,501,569 | 3/1950 | Korn | 174/53 |
| 2,531,350 | 11/1950 | Chrastina | 200/51 |
| 2,843,652 | 7/1958 | Manzella | 174/58 |
| 2,908,743 | 10/1959 | Premoshis | 174/53 |
| 2,974,301 | 3/1961 | Slater | 439/107 |
| 3,038,141 | 6/1962 | Chiuchiolo | 439/650 |
| 3,210,458 | 10/1965 | Palmer | 174/51 |
| 3,327,277 | 6/1967 | Ramsing | 439/107 |
| 3,510,822 | 5/1970 | Patterson | 439/107 |
| 3,710,287 | 1/1973 | Eckert | 439/693 |
| 3,716,651 | 2/1973 | Werner | 174/53 |
| 4,165,443 | 8/1979 | Figart et al. | 174/53 |
| 4,295,018 | 10/1981 | Borrelli | 200/51.09 |
| 4,296,275 | 10/1981 | Bowsky | 439/693 |
| 4,485,282 | 11/1984 | Lee | 174/53 |

*Primary Examiner*—Gil Weidenfeld
*Assistant Examiner*—Gary F. Paumen
*Attorney, Agent, or Firm*—Henderson & Sturm

[57] ABSTRACT

A connecting plug for use in conjunction with standard electrical boxes and circuit components such as switches and receptacles. The connecting plug includes a insulator block attached by a grounding screw to the back panel of an electrical box. Rigid contact pins extend outwardly from the insulator block a predetermined distance so that they will be releasably received in the openings in the body sections of the circuit components. Standard wiring extends through a knock-out opening in the box and is connected to the grounding screw and the contact pins. Components are removed from one replaced into the box without disturbing the wiring connections.

5 Claims, 2 Drawing Sheets

CONNECTING PLUG FOR ELECTRICAL SWITCHES AND RECEPTACLES

TECHNICAL FIELD

This invention relates to electrical circuit components and more particularly to a connecting plug for use with conventional electrical boxes and conventional switches and duplex receptacles.

BACKGROUND ART

Several devices are known which function to allow for quick and convenient removal and replacement of electrical switches and receptacles. None of these known devices, however, have been commercially accepted. In general, the known devices have many disadvantages resulting from their complex, specialized structures. None of the known devices incorporate the use of both standard electrical boxes and standard switches and receptacles.

Those concerned with these and other problems recognize the need for an improved connecting plug for electrical switches and receptacles.

DISCLOSURE OF THE INVENTION

The present invention provides a connecting plug for use in conjunction with standard electrical boxes and circuit components such as switches and receptacles. The connecting plug includes a insulator block attached by a grounding screw to the back panel of an electrical box. Rigid contact pins extend outwardly from the insulator block a predetermined distance so that they will be releasably received in the openings in the body sections of the circuit components. Standard wiring extends through a knock-out opening in the box and is connected to the grounding screw and the contact pins. Components are removed from and replaced into the box without disturbing the wiring connections.

The connecting plug can be installed in the electrical box with no more effort than is required to install the switch or receptacle. Once installed, the connecting plug allows the safe replacement of switches and receptacles without dealing with a mass of jumbled wires or wires too short to conveniently handle.

An object of the present invention is the provision of an improved connecting plug for switches and receptacles.

Another object is to provide a connecting plug that is used with standard boxes, switches, and receptacles.

A further object of the invention is the provision of a connecting plug that is easy and convenient to use.

Still another object is to provide a connecting plug that is simple in structure and inexpensive to manufacture.

A still further object of the present invention is the provision of a connecting plug that is durable and easy to maintain.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
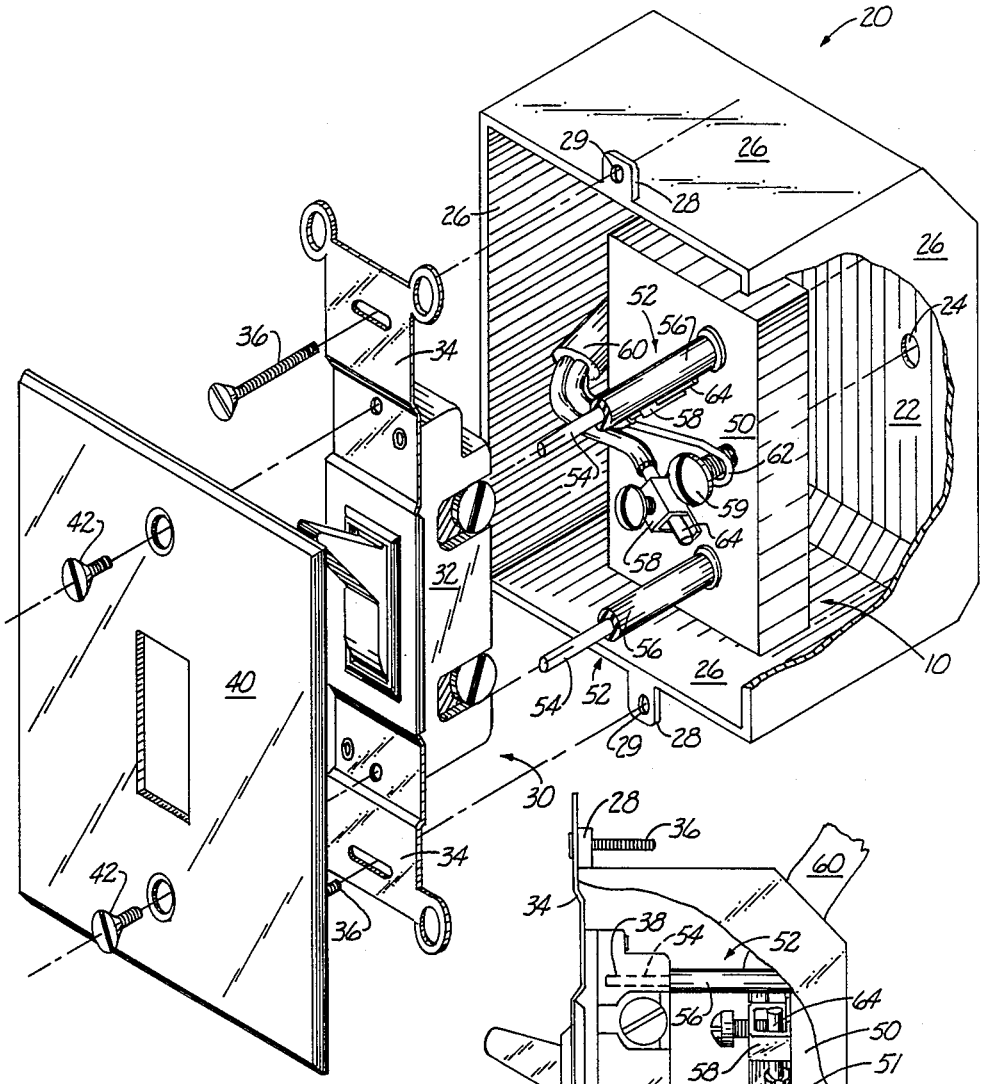
FIG. 1 is an exploded perspective view showing a connecting plug used in combination with a standard electrical box and a standard two-way switch.
Figure 4:
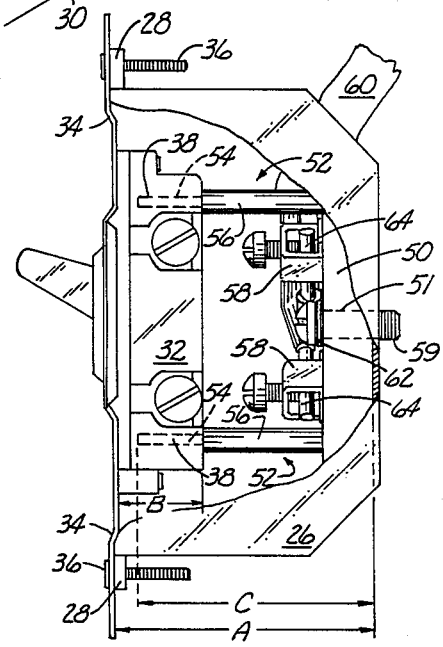
FIG. 4 is a cut-away side elevational view of the connecting plug illustrated in FIG. 1, and showing the engagement of the rigid contact pins with the openings in the body section of the switch.

Referring now to the drawings, wherein like reference numerals designate identical or corresponding parts throughout the several views, FIGS. 1 and 4 show the connecting plug (10) of the present invention used in combination with a standard electrical box (20) and a standard two-way switch (30). The electrical box (20) includes a back panel (22) having at least one threaded opening (24) formed therethrough. Side panels (26) are attached to the back panel (22) to form a box (20) of predetermined depth "A" (FIG. 4). Knock-out openings (not shown) are located in the back and side panels (22 and 26) and tabs (28), including threaded openings (29), extend normal to opposing side panels (26).

The two-way switch (30) includes a body section (32) of a predetermined thickness "B" (FIG. 4). Brackets (34) are attached to and extend out from the body section (32). Screws (36) selectively connect the brackets (34) to a corresponding tab (28). As illustrated in FIG. 4, the body section (32) includes openings (38) that are designed to receive electrical conducting elements to operably connect the switch (30) to an electrical circuit. A plate (40) is selectively attached to the switch (30) by screws (42).

The connecting plug (10) includes an insulator block (50) formed of a suitable insulating material. One suitable material is a fiberglass resin mixed with a setting agent, e.g., Evercoat Fiberglass Resin produced by FibreGlass-Evercoat Co., Inc., Cincinnati, Ohio, mixed with a setting agent (50% methyl ethyl ketone peroxide) produced by Rocket Plastics Co, Montgomery, Ohio. The insulator block (50) must be an electrical insulator that is heat resistant, durable and rigid enough to support rigid contact pins (52) that extend out from the insulator block (50).

Each contact pin (52) includes a conducting section (54) and an insulated section (56). The pins (52) are electrically connected to their respective solder-less terminal lugs (58). The insulator block (50) has an opening (51) formed therethrough to receive a grounding screw (59). As best shown in FIG. 1, the grounding screw (59) is received in the threaded opening (24) to secure the insulator block (50) to the back panel (22) of the electrical box (20). Electrical wiring (60) extends into the box (20) through the knock-out opening. The ground wire (62) is attached to the grounding screw (59) and the conducting wires (64) are attached to the appropriate lug (58), thereby electrically connecting the connecting plug (10) to an electrical power circuit (not shown).

As best shown in FIG. 4, the rigid contact pins (52) extend out from the back panel (22) a predetermined distance "C" (FIG. 4). It is critical that the contact pins

(52) be rigid, appropriately spaced, and of an appropriate length to be matingly received within the openings (38) to thereby electrically connect the switch (30) to the power circuit.

After the connecting plug (10) is secured to the box (20) and connected to the electrical wiring (60), the switch (30) can be removed and replaced without disturbing the ground wire (62) or conducting wires (64). The faulty switch (30) is simply pulled out and disengaged from the contact pins (52), and a new switch (30) is simply pushed in to engage the contact pins (52).

Figure 2:
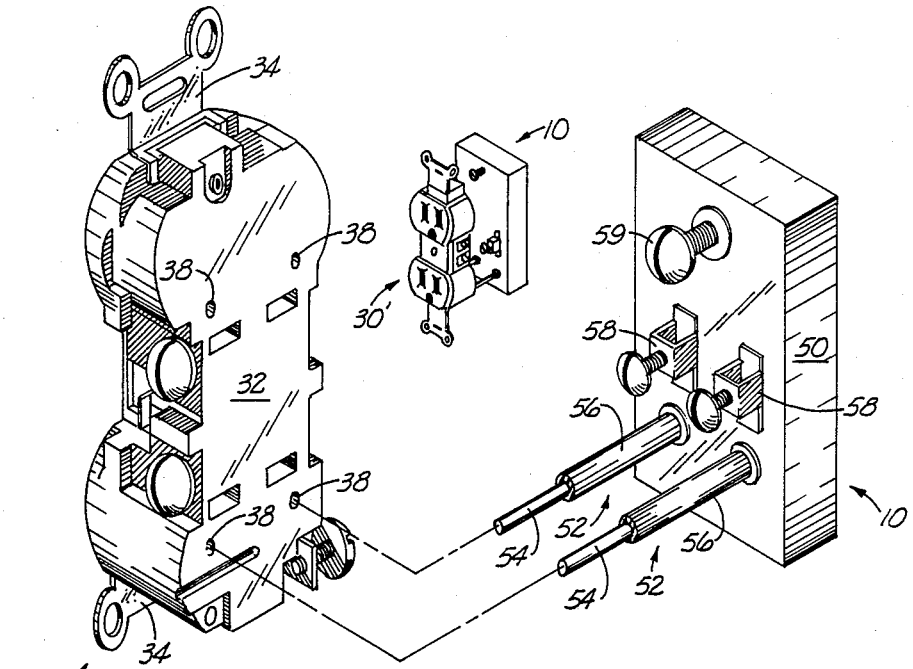
FIG. 2 is an exploded perspective view illustrating a connecting plug used in combination with a standard duplex-receptacle, with a smaller inset view illustrating the receptacle attached to the connecting plug.
Figure 3:
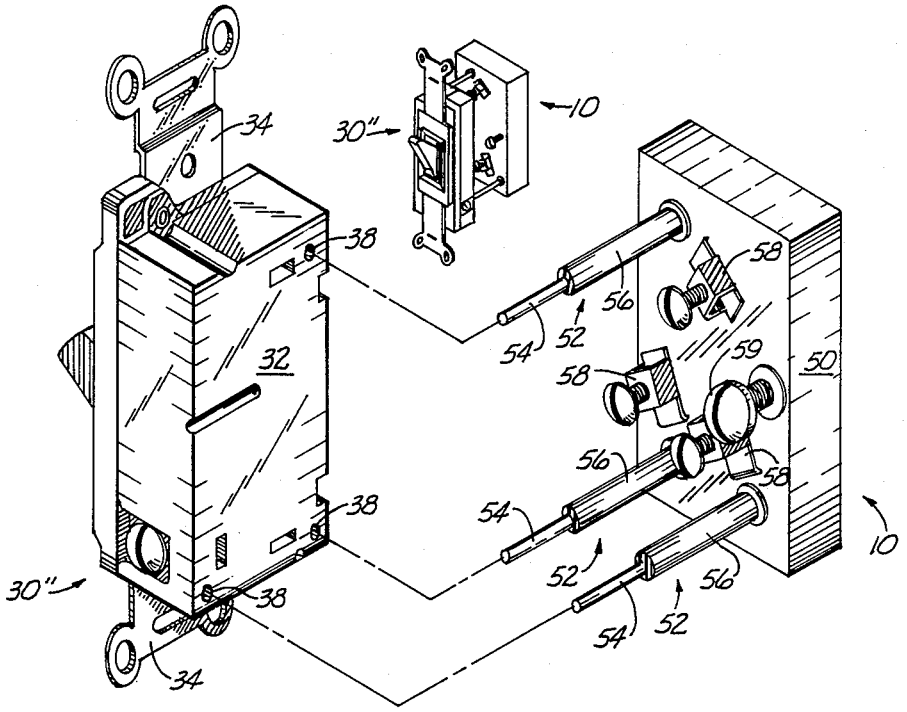
FIG. 3 is an exploded perspective view illustrating a connecting plug with three contact pins used in combination with a three-way switch, with a smaller inset view illustrating the switch attached to the connecting plug.

FIGS. 2 and 3 illustrate alternate embodiments of the connecting plug (10) suitable for use with duplex-receptacles (30′) and three-way switches (30″), respectively.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. A connecting plug for use in conjunction with a conventional electrical box and a plurality of conventional electrical circuit components, said conventional conductive electrical box having a back panel with at least one threaded opening, and side panels attached to said back panel to form an open box of predetermined depth; said plurality of conventional electrical circuit components each including a body section of a predetermined thickness, and brackets attached to and extending longitudinally out from said body section, said brackets being disposed to engage the side panels of said electrical box for attachment thereto, said body section being disposed to extend into said electrical box when said brackets are securely attached to said box, said body section including at least two openings disposed to receive electrical conducting elements operably connected to an electrical circuit, the improvement consisting of:

said connecting plug comprising an insulator block disposed within said electrical box in contact with said back panel and secured thereto by a grounding screw; wherein said insulator block includes an opening therethrough to receive said grounding screw, said grounding screw being received within said threaded opening in said back panel, said grounding screw further being disposed to receive and secure a ground wire of an electrical circuit;

a first said electrical conducting element comprising a first rigid contact pin secured to and extending out from said insulator block, said first pin being insulated from said box and disposed to extend outwardly from said back panel a predetermined distance to thereby be releasably received within one of said electrical circuit components body section openings when a selected one of the said plurality of components is securely attached to said box;

means for electrically connecting said first pin to a first conducting wire of an electrical circuit;

a second said electrical conducting element comprising a second rigid contact pin secured to and extending from said insulator block, said second pin being insulated from said box and disposed to extend outwardly from said back panel a predetermined distance to thereby be releasably received within the other of said electrical circuit component body openings when said component is securely attached to said box;

means for electrically connecting said second pin to a second conducting wire of an electrical circuit; wherein said first pin and said second pin include an insulated section extending between said insulator block and the body section of the selected one of said plurality of conventional electrical circuit components; and, wherein said first pin electrical connecting means and said second pin electrical connecting means includes a solder-less terminal lug secured to said insulator block.

2. The connecting plug of claim 1 wherein said body section of said electrical circuit component includes a third opening disposed to receive electrical conducting elements, and wherein said connecting plug further includes:

a third rigid contact pin secured to and extending from said insulator block, said third pin being insulated from said box and disposed to extend outwardly from said back panel a predetermined distance to thereby be releasably received with the third opening when said component is securely attached to said box; and means for electrically connecting said third pin to a third conducting wire of an electrical circuit.

3. The connecting plug of claim 1 wherein one of said plurality of conventional electrical circuit components is a two-way switch.

4. The connecting plug of claim 1 wherein one of said plurality of conventional electrical circuit components is a duplex receptacle.

5. The connecting plug of claim 2 wherein one of said plurality of conventional electrical circuit components is a three-way switch.

* * * * *